US008650773B2

(12) United States Patent
Ackermann et al.

(10) Patent No.: US 8,650,773 B2
(45) Date of Patent: Feb. 18, 2014

(54) DRYING BASKET AND FASTENING DEVICE FOR FASTENING A DRYING BASKET ON A CLOTHES DRYER

(75) Inventors: Uwe Ackermann, Schoenwalde-Glien (DE); Lothar Dittmer, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2174 days.

(21) Appl. No.: 10/583,628

(22) PCT Filed: Dec. 23, 2004

(86) PCT No.: PCT/EP2004/053696

§ 371 (c)(1),
(2), (4) Date: Jun. 20, 2006

(87) PCT Pub. No.: WO2005/064070

PCT Pub. Date: Jul. 14, 2005

(65) Prior Publication Data

US 2007/0119071 A1 May 31, 2007

(30) Foreign Application Priority Data

Dec. 23, 2003 (DE) ..... 103 60 872

(51) Int. Cl.
*F26B 11/02* (2006.01)

(52) U.S. Cl.
USPC ..... 34/600; 34/194; 34/204; 34/237

(58) Field of Classification Search
USPC ..... 34/602, 600, 601, 599, 317, 192, 322, 34/82, 85, 87, 603, 184, 193, 194, 195, 34/196, 204, 216, 237, 238, 239
See application file for complete search history.

(56) References Cited

U.S. PATENT DOCUMENTS

| | | | | |
|---|---|---|---|---|
| 3,316,659 | A | 5/1967 | Lauck | |
| 4,091,548 | A | 5/1978 | Daily | |
| 4,677,760 | A * | 7/1987 | St. Louis | 34/90 |
| 4,720,925 | A * | 1/1988 | Czech et al. | 34/82 |
| 4,908,959 | A * | 3/1990 | Kretchman et al. | 34/609 |
| 6,026,592 | A * | 2/2000 | Herr | 34/446 |
| 6,385,862 | B1 * | 5/2002 | Vande Haar | 34/441 |
| 2003/0010736 | A1 | 1/2003 | Hope | |

FOREIGN PATENT DOCUMENTS

| | | | | |
|---|---|---|---|---|
| DE | 27 06 595 | A1 * | 11/1977 | D06F 58/00 |
| DE | 40 34 660 | | 5/1992 | |
| GB | 1 491 852 | | 11/1977 | |
| JP | 09-220399 | * | 8/1997 | D06F 58/02 |

OTHER PUBLICATIONS

Maytag Appliances Sales Co. (Maytag Neptune Dryer) 2004, [online], [retrieved on Aug. 10, 2009] Retrieved from the Maytag Owners Center Manuals and Literature for model MDE7500 using Internet <URL: http://shared.whirlpoolcorp.com/product_literature/search_results.jsp?searchTerm=MDE7500&siteCd=MT_EN_US>.*

International Search Report PCT/EP2004/053696.

* cited by examiner

*Primary Examiner* — Kenneth Rinehart
(74) *Attorney, Agent, or Firm* — James E. Howard; Andre Pallapies

(57) ABSTRACT

A drying basket for a clothes dryer, comprising a longitudinal support and a wire basket fastened thereto. A connecting device is integrally configured on the longitudinal support and can be engaged with an opening provided on the clothes dryer. For this purpose, an opening is provided on the clothes dryer in a section of the clothes dryer housing, with which the connecting device of a drying basket can be engaged.

15 Claims, 2 Drawing Sheets

DRYING BASKET AND FASTENING DEVICE FOR FASTENING A DRYING BASKET ON A CLOTHES DRYER

FIELD OF THE INVENTION

This invention relates to a drying basket and a fastening device for a drying basket on a drier.

BACKGROUND OF THE INVENTION

Drying baskets are used in driers with a rotary drum in order to dry sensitive items of clothing or shoes which must not be subjected to movement in the air flow of a drier. A drying basket is suspended for this purpose in the region of the door folding of the feed door of a drier, and therefore projects with its basket into the interior of the drum so that sensitive items or clothing or shoes can be dried on it, since the drying basket is not secured in the interior of the drier so that it also rotates. Furthermore, a method is known for removing the lint screen installed underneath the door in the front end plate and suspending the drying basket in the lower end plate in the opening thus formed. In most cases drying baskets are very expensive wire braids with special hook-shaped connecting elements welded onto them. A drying basket may also consist of a combination of a plastic basket with reinforcing and fastening elements.

SUMMARY OF THE INVENTION

The object of this invention is to make available a drying basket for a drier, which basket is of simple construction and is easy to handle.

A drying basket for a drier has a longitudinal support and a lattice-shaped basket fastened to it. Because a connecting device is formed integrally on the longitudinal support and can be engaged with an opening provided on the drier, a simple construction of a drying basket is made available. Because the connecting device is formed integrally on the longitudinal support, the flow of force and the introduction of force into the connecting device is optimised, in which case the structural design is simple and consists of few parts.

In an advantageous embodiment, the longitudinal support is designed as a wire and the connecting device is designed as a hook. In this case the hook is formed on an end section of the wire, preferably by means of a bending process. This type of design of a hook at the end of a wire is particularly simple and appropriate.

In an advantageous embodiment, the connecting device has a support section on the longitudinal support, with which section the connecting device is supported on the housing section of the driver. Consequently a simple connecting device is made available in that the drying basket can first be engaged with the hook in the opening on the drier, and is then lowered and is additionally supported with the support section on a housing section of the drier. A drying basket that is easy to handle is therefore made available.

In a preferred embodiment, a longitudinal support is arranged on both longitudinal sides of the drying basket, which supports can be engaged with an opening provided on the drier. Here the connecting device is designed as a hook on an end section of the longitudinal support. This provides extremely simple handling when the drying basket is inserted in and removed from the drier.

Since a fastening device for a drying basket is provided on a drier with a housing by providing an opening on one section of the housing of the drier, with which opening a connecting device of a drying basket can be engaged, a simple, reliable connection, that does not damage any components of the drier, can be achieved between the drying basket and the drier. It is not necessary to secure the basket in a door folding or on a door seal or the like, so that the components of the drier are not damaged.

In a preferred embodiment, the housing of the drier has a front end plate, wherein openings are arranged in the front end plate. This arrangement is therefore advantageous because the region of the air inlet grid or the air outlet grid in the drier is normally also located on the front end plate, so that the objects to be dried on the drying basket occupy the optimum position in the air flow.

In a preferred embodiment, a replaceable lint filter is provided in the housing, wherein the opening is arranged adjacent to the lint filter.

In a preferred embodiment, the opening is covered by the inserted lint filter both when the drying basket is fitted and when it is not. This means that the user must previously remove the lint filter automatically during initial commissioning when he wants to remove the drying basket. It is therefore pointed out to the user that a lint filter is provided which must also be cleaned at regular intervals. Incorrect use of the drier is therefore avoided, resulting in a reduction in customer service operations.

In a preferred embodiment, the lint screen is arranged in the lower section of the front end plate and an opening is arranged on each side of the lint filter.

Further details, features and advantages of the invention are evident from the following description of a preferred exemplary embodiment of a drying basket according to the invention for a drier, and of a fastening device for a drying basket on a drier with reference to the drawings.

DETAILED DESCRIPTION OF PREFERRED EMBODIMENTS

Figure 1:
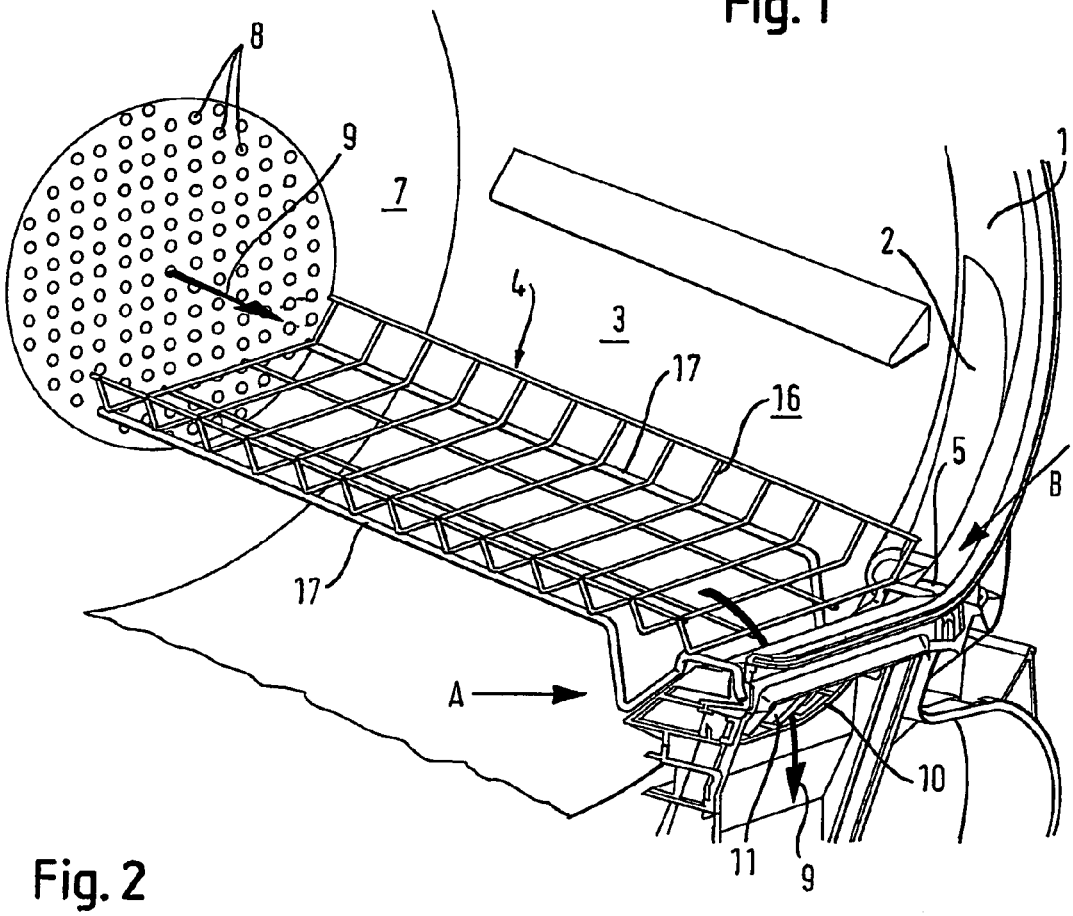
FIG. 1 shows a partial perspective view through the feed opening into the interior of a drier with a drying basket fitted.
Figure 6:
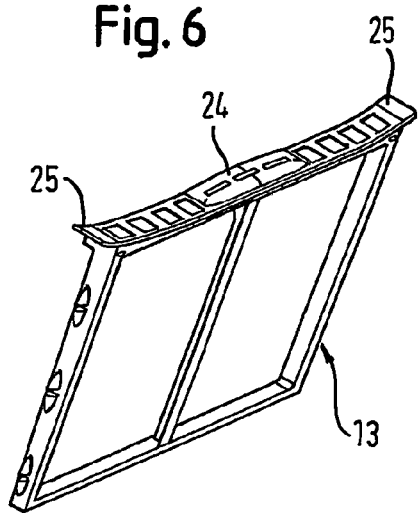
FIG. 6 shows a lint filter in the disassembled condition.

FIG. 1 shows a partial perspective view into the interior of a drier. The drier has a feed opening 1, a front end plate 2 adjacent to feed opening 1 on the inside of feed opening 1, a rotary drum 3, a drying basket 4, which can be suspended in two openings 5 and 6, which are arranged in the lower section of end plate 2. Drum 3 has a rear wall 7 which is provided with a multiplicity of inlet openings 8 through which hot process air is able to enter drum 3 (arrow 9). On the lower section of front end plate 2 is arranged an outlet grid 10 with a multiplicity of outlet openings 11 through which the process air escapes again from drum 3 (arrow 9). On the lower section of feed opening 1, which is formed in end plate 2, is formed a recess 12 (see also FIG. 4) into which a lint screen 13 according to FIG. 6 can be inserted so that it comes to rest behind outlet grid 10 or downstream from outlet grid 10 transverse to the direction of flow 9. End plate 2 forms part of a housing 26 of the drier.

Figure 4:
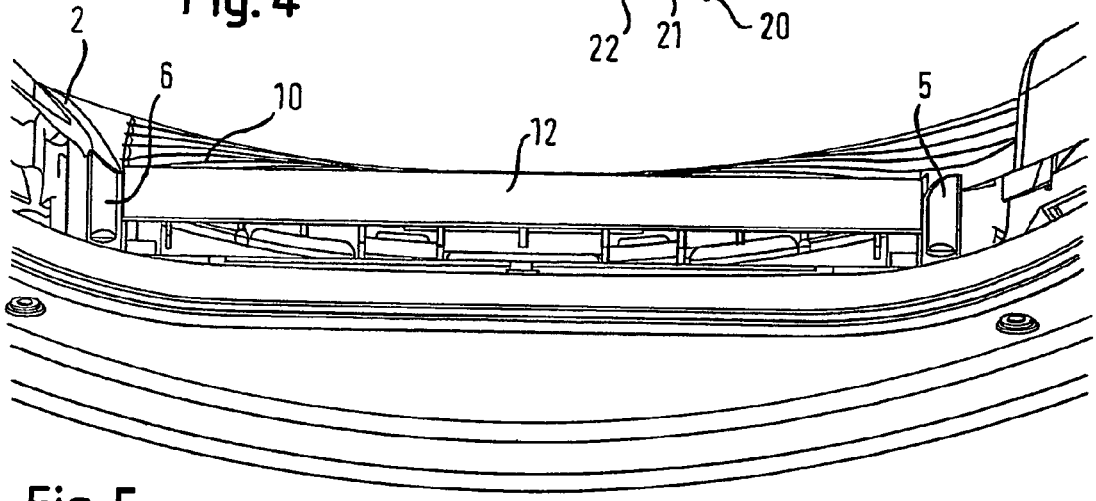
FIG. 4 shows a detail view taken along arrow B in FIG. 1 on the lower section of the end plate, with the lint filter and drying basket removed.

According to FIG. 4 an opening 5 and 6 is arranged in end plate 2 on both sides of recess 12.

Figure 3:
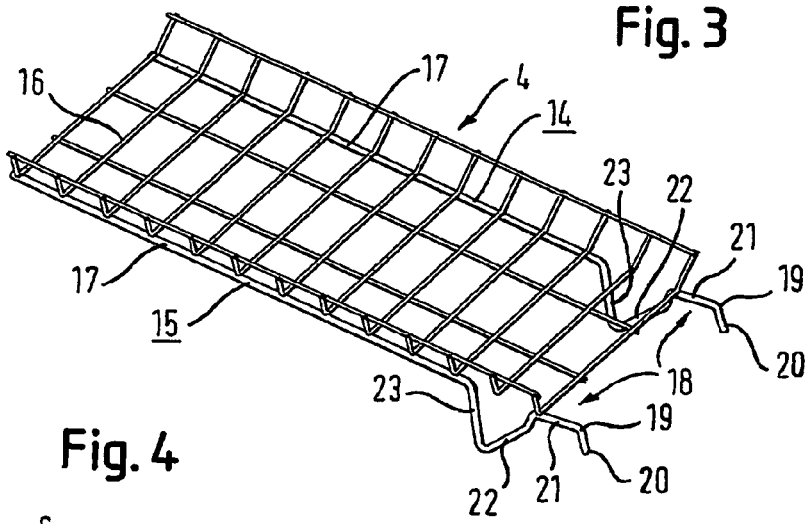
FIG. 3 shows a drying basket for installation in the drier.

FIG. 3 shows drying basket 4 in greater detail. The drying basket has longitudinal supports 14 and 15 manufactured from a thick wire on both longitudinal sides. A grid-shaped basket 16, which is bent upwards on the side, is arranged on both longitudinal supports 14 and 15. Grid-shaped basket 16 is manufactured from a thin wire. A longitudinal support 14 or 15 has a long, straight support section 17 and, in the front section, a connecting device 18 which is formed integrally on longitudinal support 14 and 15 respectively by means of a bending process. Connecting device 18 has, on the front end, a hook 19 which is formed as a bending section 20, itself formed at the bottom and pointing obliquely forward. A horizontal section 21 is connected to the bending section 20. Another bent section 22, which is bent obliquely downwards, is in turn connected to the horizontal section 21. A section 23, bent upwards, is in turn connected to section 22, and section 23 passes into support section 17.

Lint filter 13 has an upper diaphragm 24, which, when lint filter is fitted, covers recess 12. The upper diaphragm 24 has a projection 25 on each side, which projection covers openings 5 and 6 in front end plate 2 when lint filter 13 is fitted. Openings 5 and 6 in front end plate 2 are in this case covered by projections 25 of upper diaphragm 24 of lint filter 13 when drying basket 4 is fitted and also when drying basket 4 is not fitted.

Figure 2:
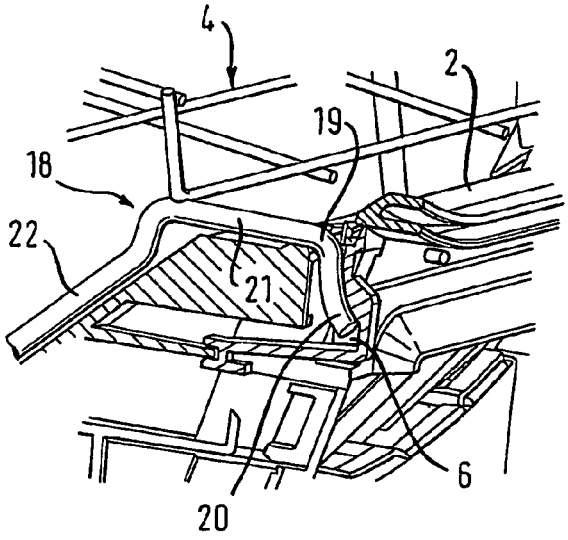
FIG. 2 shows an enlarged detail view taken along arrow A in FIG. 1.
Figure 5:
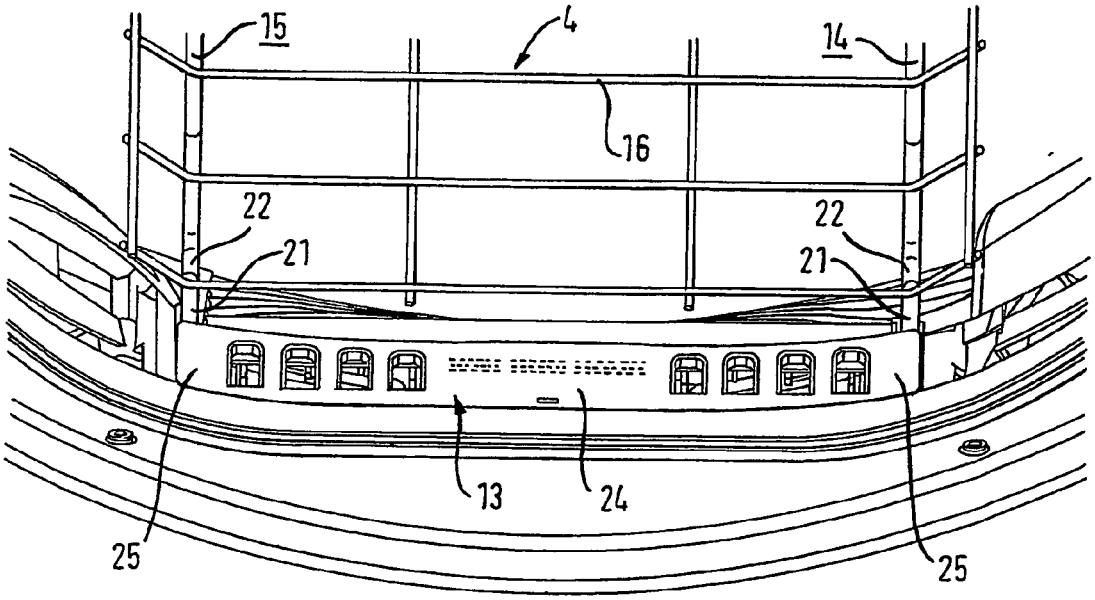
FIG. 5 shows a detail view taken along arrow B in FIG. 1 on the lower section of the end plate, with the drying basket and lint filter installed.

For installation of drying basket 4 lint filter 13 is first removed so that openings 5 and 6 become accessible, as shown in FIG. 4. Drying basket 4 is then inserted in opening 5 and 6 with hook 19 and section 20 pointing obliquely forward, respectively, until drying basket 4, with its horizontal section 21 and its downwardly bent section 20, comes to rest at the corresponding points of end plate 2. Lint filter 13 is now fitted again so that diaphragm 24 of lint filter 13 covers recess 12 and the lateral projections 25 cover the openings 5 and 6 in end plate 2 (see FIGS. 2 and 5). Drying basket 4 is dismantled in reverse order.

The invention claimed is:

1. A drier, comprising:

a rotary drum that can be fed through a feed opening, through which drum process air is able to flow from a rear wall into an end plate having two openings adjacent to the feed opening; and a drying basket with a lattice type basket projecting into the drum, the drying basket including two longitudinal supports in the form of wires, the supports comprising integral connecting devices that each include a bent end section and a bent support section located between the bent end section and the longitudinal support, wherein the basket is supported demountably on the end plate, and wherein the basket is mounted by inserting the bent end sections into the openings in the end plate and allowing the bent support sections to rest against the end plate.

2. The drier according to claim 1, wherein the drying basket has a longitudinal support on both longitudinal sides.

3. The drier according to claim 1, wherein a demountable lint filter is arranged in the end plate, which filter is adjacent to the opening.

4. The drier according to claim 3, wherein the openings in the end plate and the connecting devices are covered by the lint filter.

5. The drier according to claim 1, wherein the engagement of the bent end section in the opening and the engagement of the bent support section with the end plate support cause the drying basket to project into the drum in a cantilevered fashion.

6. The drier of claim 1, further comprising a lint filter that is mounted in a slot formed in the end plate, wherein the lint filter covers the openings in the end plate and the bent end sections of the wires.

7. A laundry drier comprising:

a housing;

a rotary drum disposed within the housing and including a rear wall having inlet openings through which an air flow enters the rotary drum;

a feed opening in the housing providing access to the rotary drum;

an end plate disposed near a lower portion of the feed opening and including two basket openings disposed near opposing ends of the end plate;

a drying basket including two elongated longitudinal supports in the form of wires and a lattice type basket supported by the longitudinal supports, each longitudinal support including a connecting device comprising a bent end section that forms a hook and a bent supporting section located between the bent end section and the lattice basket, the drying basket being removably connected to the end plate and projecting into the rotary drum toward the rear wall with each of the basket openings receiving one of the bent end sections, and each of the supporting sections engaging a surface of the end plate to support the drying basket within the rotary drum.

8. The laundry drier according to claim 7, wherein the longitudinal support and connecting device are integrally formed from a rigid wire member having various angled sections bent into the desired configuration.

9. The laundry drier according to claim 7, wherein each bent end section includes a bending section curving away from the drying basket.

10. The laundry drier according to claim 7, further comprising a removable lint filter including a lint screen and an elongated upper diaphragm having a projection at each opposing end of the upper diaphragm, the end plate including an elongated recess extending between the basket openings and the lint filter being received into the recess.

11. The laundry drier according to claim 10, wherein the each projection extends over one of the basket openings and restricts the bent end sections from being removed from the basket openings.

12. The laundry drier of claim 7, wherein the engagement between the bent end sections and the basket openings and between the bent supporting sections and the end plate cause the drying basket to project into rotary drum in a cantilevered fashion.

13. The laundry drier of claim 7, wherein the mounting of the bent end sections into the basket openings and the engagement between the bent supporting sections and the end plate do not prevent a lint filter from being mounted in a recess in the end plate.

14. A method for removably connecting a drying basket to a laundry drier, the method comprising the following acts:

providing the laundry drier comprising a housing, a rotary drum disposed within the housing, a feed opening in the housing providing access to the rotary drum, and an end plate disposed near a lower portion of the feed opening and including two basket openings;

providing the drying basket including two elongated longitudinal supports and a lattice type basket supported by the longitudinal supports, each longitudinal support including a connecting device having a bent end section in the form of a hook and a bent supporting section located between the lattice type basket and the bent end section;

inserting each bent end section into one of the basket openings with the drying basket projecting into the rotary drum; and positioning each bent supporting section on a surface of the end plate to support the drying basket within the rotary drum.

15. The method according to claim 14, further comprising:

providing a lint filter including a lint screen and an elongated upper diaphragm having a projection at each opposing end of the upper diaphragm;

providing an elongated recess within the end plate extending between the basket openings;

inserting the lint filter into the recess with each of the projections extending over one of the basket openings and restricting the bent end sections from being removed from the basket openings.

* * * * *